US010181300B2

(12) United States Patent
He

(10) Patent No.: US 10,181,300 B2
(45) Date of Patent: Jan. 15, 2019

(54) PRECOMPENSATION METHOD AND DEVICE OF ADJUSTING LUMINANCE AND CHROMATICITY OF PANEL

(71) Applicant: Shenzhen China Star Optoelectronics Technology Co., Ltd., Shenzhen (CN)

(72) Inventor: Jian He, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 280 days.

(21) Appl. No.: 15/120,746

(22) PCT Filed: Jun. 21, 2016

(86) PCT No.: PCT/CN2016/086544
§ 371 (c)(1),
(2) Date: Aug. 23, 2016

(87) PCT Pub. No.: WO2017/210922
PCT Pub. Date: Dec. 14, 2017

(65) Prior Publication Data

US 2018/0204530 A1 Jul. 19, 2018

(30) Foreign Application Priority Data

Jun. 6, 2016 (CN) ..... 2016 1 0395640

(51) Int. Cl.
*G09G 3/36* (2006.01)
*G09G 3/3208* (2016.01)
(Continued)

(52) U.S. Cl.
CPC ..... *G09G 3/3607* (2013.01); *G09G 3/20* (2013.01); *G09G 3/32* (2013.01); *G09G 3/3208* (2013.01);
(Continued)

(58) Field of Classification Search
CPC ..... G09G 2320/0276; G09G 2340/06; G09G 3/2003; G09G 2320/0242; G09G 2320/0666; G09G 2320/0673
See application file for complete search history.

(56) References Cited

U.S. PATENT DOCUMENTS 8,884,995 B2 * 11/2014 Kwak ..... G09G 3/2003 345/690
9,251,761 B2 * 2/2016 Shigeta ..... G01J 3/506
2009/0167734 A1 * 7/2009 Chian-Hung ..... G09G 3/2081 345/205

* cited by examiner

*Primary Examiner* — Koosha Sharifi-Tafreshi
(74) *Attorney, Agent, or Firm* — Leong C. Lei

(57) ABSTRACT

The present invention relates to a precompensation method and a device of adjusting luminance and chromaticity of a panel. The method comprises: step 10, adjusting the gamma voltage of the first sub pixel to make a first sub pixel gray scale luminance be $Lum_{T'}$; step 20, adjusting the gamma voltage of the second sub pixel to make a second sub pixel gray scale chromaticity be $y_{T'}$; step 30, adjusting the gamma voltage of the third sub pixel to make a third sub pixel gray scale chromaticity be $x_T$; step 40, judging whether specifications is met or not, and if they are, finishing the adjustment, and if they are not, then returning back to the step 10, and restart the adjustment. The present invention further provides a precompensation device of adjusting luminance and chromaticity of a panel.

5 Claims, 5 Drawing Sheets

(51) Int. Cl.
*G09G 3/20* (2006.01)
*G09G 3/32* (2016.01)

(52) U.S. Cl.
CPC ... *G09G 3/3696* (2013.01); *G09G 2320/0276* (2013.01); *G09G 2320/0626* (2013.01)

curve of adjusting R chromaticity x variation in accordance withluminance variation adjusting B chromaticity y variation in accordance with luminance variation curve of adjusting R chromaticity x variation in accordance with chromaticity y variation

PRECOMPENSATION METHOD AND DEVICE OF ADJUSTING LUMINANCE AND CHROMATICITY OF PANEL

FIELD OF THE INVENTION

The present invention relates to a display technology field, and more particularly to a precompensation method and a device of adjusting luminance and chromaticity of a panel.

BACKGROUND OF THE INVENTION

The Liquid Crystal Display (LCD), Organic Light Emitting Diode (OLED) and other panel display devices have already replaced the CRT displays and become the major production in the present display device market. The display panel is an important component of the LCD, OLED and other panel display devices. For the LCD, the structure of the liquid crystal display panel generally comprises a Color Filter (CF), a Thin Film Transistor Array Substrate (TFT Array Substrate), and a Liquid Crystal Layer arranged between the two substrates. The working principle is that the light of backlight module is reflected to generate images by applying driving voltages to the two glass substrate for controlling the rotations of the liquid crystal molecules.

As considering the panel quality, the image quality is very important. In the manufacture process, the color temperature and luminance of the gray scale white point is the importance reference values that the panel maker judges the panel performance. In the common panel, the pixel is employed to be a display unit, and each pixel comprises RGB, three sub pixels. Thus, it requires adjusting the color temperature and luminance of the white point by adjusting the luminances of the RGB, three sub pixels. The luminances of the RGB, three sub pixels can be realized by adjusting the Gamma reference voltages respectively corresponded with the RGB, three sub pixels. As shown in FIG. 1, which is a flowchart of correcting the luminance and the chromaticity of the panel by adjusting the RGB gamma voltage according to prior art, in which the gamma voltage correction luminance Lum of sub pixel G is adjusted, and the gamma voltage correction chromaticity y of the sub pixel B is adjusted, and the gamma voltage correction chromaticity x of the sub pixel R is adjusted in sequence. The method specifically comprises: adjusting the gamma voltage of the sub pixel G to make the luminance Lum to the target; adjusting the gamma voltage of the sub pixel B to make the chromaticity y to the target; adjusting the gamma voltage of the sub pixel R to make the chromaticity x to the target; judging whether the specifications are met, and if they meet, finishing the adjustment, and if they do not meet, then restarting the adjustment in order.

The reason of restart the adjustment is because that the process of adjusting the chromaticities of the sub pixel R and the sub pixel B also has some influence to the luminance Lum, and meanwhile, the adjustment of the sub pixel R also has influence to the chromaticity y. Thus, as the adjustment of the chromaticity x of the sub pixel R is finished, there is possibility that the luminance Lum and the chromaticity y exceed the specifications, and then the adjustment has to be restarted once in order of G→B→R, which takes a lot of time, and the vibration also may occur, and the adjustment efficiency is not high.

SUMMARY OF THE INVENTION

Thus, an objective of the present invention is to provide a precompensation method of adjusting luminance and chromaticity of a panel, which the possible impact bias of the chromaticity to the luminance is pre considered in the setting of the target luminance to prevent the repeated cycle adjustment.

Another objective of the present invention is to provide a precompensation device of adjusting luminance and chromaticity of a panel, which the possible impact bias of the chromaticity to the luminance is pre considered in the setting of the target luminance to prevent the repeated cycle adjustment.

For realizing the aforesaid objectives, the present invention provides a precompensation method of adjusting luminance and chromaticity of a panel, comprising:

employing $Lum_T$, $y_T$ and $x_T$ to respectively represent a first sub pixel target gray scale luminance, a second sub pixel target gray scale chromaticity and a third sub pixel target gray scale chromaticity; employing $Lum_c$ to represent a first sub pixel gray scale luminance precompensation value, and employing $y_c$ to represent a second sub pixel gray scale chromaticity precompensation value; employing $\Delta y$ to represent a second sub pixel gray scale chromaticity variation value adjusted and corresponded with a gamma voltage of a second sub pixel, and employing $\Delta x$ to represent a third sub pixel gray scale chromaticity variation value adjusted and corresponded with a gamma voltage of a third sub pixel; and sequentially performing:

step 10, adjusting the gamma voltage of the first sub pixel to make a first sub pixel gray scale luminance be $Lum_{T'}$;

$$\begin{cases} Lum'_T = Lum_T + Lum_c \\ Lum_c = k_x * \Delta x + k_y * \Delta y \end{cases},$$

wherein $k_y$ is a variation coefficient of $\Delta y$ to the first sub pixel gray scale luminance, and $k_x$ is a variation coefficient of $\Delta x$ to the first sub pixel gray scale luminance;

step 20, adjusting the gamma voltage of the second sub pixel to make a second sub pixel gray scale chromaticity be $y_{T'}$;

$$\begin{cases} y'_T = y_T + y_c \\ y_c = h_x * \Delta x \end{cases},$$

wherein $h_x$ is a variation coefficient of $\Delta x$ to the second sub pixel gray scale chromaticity;

step 30, adjusting the gamma voltage of the third sub pixel to make a third sub pixel gray scale chromaticity be $x_T$;

step 40, judging whether the luminance and the chromaticity meet specifications or not, and if they meet, finishing the adjustment, and if they do not meet, then returning back to the step 10, and restart the adjustment.

Adjusting the gamma voltage utilizes linear estimation iteration.

The precompensation method of adjusting luminance and chromaticity of the panel comprises:

identifying that variation of the gray scale luminance or gray scale chromaticity as a target and the gamma voltage meet a linear relationship, and obtaining a gamma voltage value corresponded with the target according to a linear computation;

judging whether the target corresponding to the obtained gamma voltage value meets the specifications or not, and if it does not meet, keeping the linear estimation according to the obtained gamma voltage value.

wherein the first sub pixel, the second sub pixel and the third sub pixel are a sub pixel G, a sub pixel B and a sub pixel R constituting a pixel.

The first sub pixel is a sub pixel G, and the second sub pixel is a sub pixel B and the third sub pixel is a sub pixel R.

For realizing the aforesaid objectives, the present invention further provides a precompensation device of adjusting luminance and chromaticity of a panel, which can correspondingly performing the precompensation method of adjusting luminance and chromaticity of the panel according to the present invention, comprising:

employing $Lum_T$, $y_T$ and $x_T$ to respectively represent a first sub pixel target gray scale luminance, a second sub pixel target gray scale chromaticity and a third sub pixel target gray scale chromaticity; employing $Lum_c$ to represent a first sub pixel gray scale luminance precompensation value, and employing $y_c$ to represent a second sub pixel gray scale chromaticity precompensation value; employing Δy to represent a second sub pixel gray scale chromaticity variation value adjusted and corresponded with a gamma voltage of a second sub pixel, and employing Δx to represent a third sub pixel gray scale chromaticity variation value adjusted and corresponded with a gamma voltage of a third sub pixel; a first sub pixel adjusting module, a second sub pixel adjusting module, a sub pixel adjusting module and a judging module, which sequentially works:

the first sub pixel adjusting module, adjusting the gamma voltage of the first sub pixel to make a first sub pixel gray scale luminance be $Lum_{T'}$;

$$\begin{cases} Lum'_T = Lum_T + Lum_c \\ Lum_c = k_x * \Delta x + k_y * \Delta y \end{cases},$$

wherein $k_y$ is a variation coefficient of Δy to the first sub pixel gray scale luminance, and $k_x$ is a variation coefficient of Δx to the first sub pixel gray scale luminance;

the second sub pixel adjusting module, adjusting the gamma voltage of the second sub pixel to make a second sub pixel gray scale chromaticity be $y_{T'}$;

$$\begin{cases} y'_T = y_T + y_c \\ y_c = h_x * \Delta x \end{cases},$$

wherein $h_x$ is a variation coefficient of Δx to the second sub pixel gray scale chromaticity;

the third sub pixel adjusting module, adjusting the gamma voltage of the third sub pixel to make a third sub pixel gray scale chromaticity be $x_T$;

the judging module, judging whether the luminance and the chromaticity meet specifications or not, and if they meet, finishing the adjustment, and if they do not meet, then the judging module restarting the adjustment.

Adjusting the gamma voltage utilizes linear estimation iteration.

The precompensation method of adjusting luminance and chromaticity of the panel comprises:

identifying that variation of the gray scale luminance or gray scale chromaticity as a target and the gamma voltage meet a linear relationship, and obtaining a gamma voltage value corresponded with the target according to a linear computation;

judging whether the target corresponding to the obtained gamma voltage value meets the specifications or not, and if it does not meet, keeping the linear estimation according to the obtained gamma voltage value.

wherein the first sub pixel, the second sub pixel and the third sub pixel are a sub pixel G, a sub pixel B and a sub pixel R constituting a pixel.

The first sub pixel is a sub pixel G, and the second sub pixel is a sub pixel B and the third sub pixel is a sub pixel R.

The present invention further provides a precompensation device of adjusting luminance and chromaticity of a panel, comprising:

employing $Lum_T$, $y_T$ and $x_T$ to respectively represent a first sub pixel target gray scale luminance, a second sub pixel target gray scale chromaticity and a third sub pixel target gray scale chromaticity; employing $Lum_c$ to represent a first sub pixel gray scale luminance precompensation value, and employing $y_c$ to represent a second sub pixel gray scale chromaticity precompensation value; employing Δy to represent a second sub pixel gray scale chromaticity variation value adjusted and corresponded with a gamma voltage of a second sub pixel, and employing Δx to represent a third sub pixel gray scale chromaticity variation value adjusted and corresponded with a gamma voltage of a third sub pixel; a first sub pixel adjusting module, a second sub pixel adjusting module, a sub pixel adjusting module and a judging module, which sequentially works:

the first sub pixel adjusting module, adjusting the gamma voltage of the first sub pixel to make a first sub pixel gray scale luminance be $Lum_{T'}$;

$$\begin{cases} Lum'_T = Lum_T + Lum_c \\ Lum_c = k_x * \Delta x + k_y * \Delta y \end{cases},$$

wherein $k_y$ is a variation coefficient of Δy to the first sub pixel gray scale luminance, and $k_x$ is a variation coefficient of Δx to the first sub pixel gray scale luminance;

the second sub pixel adjusting module, adjusting the gamma voltage of the second sub pixel to make a second sub pixel gray scale chromaticity be $y_{T'}$;

$$\begin{cases} y'_T = y_T + y_c \\ y_c = h_x * \Delta x \end{cases},$$

wherein $h_x$ is a variation coefficient of Δx to the second sub pixel gray scale chromaticity;

the third sub pixel adjusting module, adjusting the gamma voltage of the third sub pixel to make a third sub pixel gray scale chromaticity be $x_T$;

the judging module, judging whether the luminance and the chromaticity meet specifications or not, and if they meet, finishing the adjustment, and if they do not meet, then the judging module restarting the adjustment;

wherein adjusting the gamma voltage utilizes linear estimation iteration;

wherein the first sub pixel, the second sub pixel and the third sub pixel are a sub pixel G, a sub pixel B and a sub pixel R constituting a pixel.

In conclusion, the precompensation method and the device of adjusting luminance and chromaticity of the panel according to the present invention introduces the precompensation correction mechanism capable of preventing circular multiple adjustments to shorten the adjustment time and to raise the efficiency; the vibration occurrence in the adjustment can be effectively prevented to adjust the condition of being eventually unable to converge; furthermore, linear estimation iteration is introduced to adjust the gamma voltage to raise the efficiency of adjusting the gamma voltage.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

Figure 1:
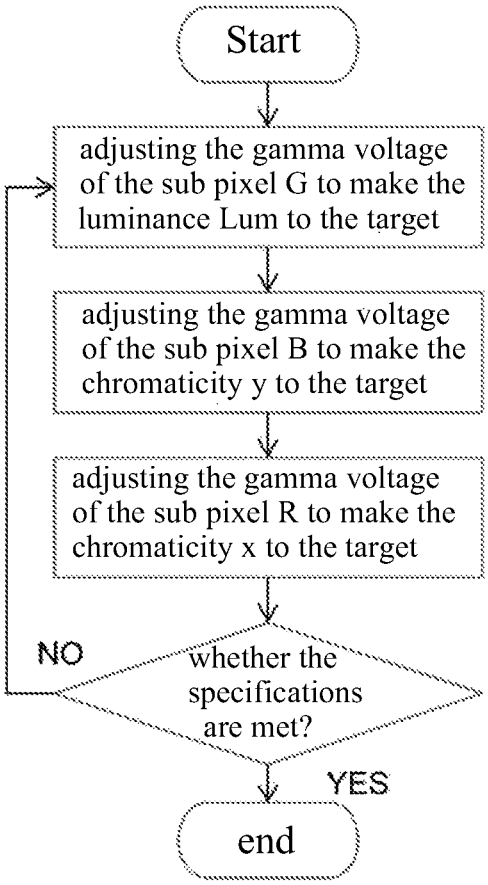
Fig. 1 (Prior Art)
FIG. 1 is a flowchart of correcting the luminance and the chromaticity of the panel by adjusting the RGB gamma voltage according to prior art.
Figure 2:
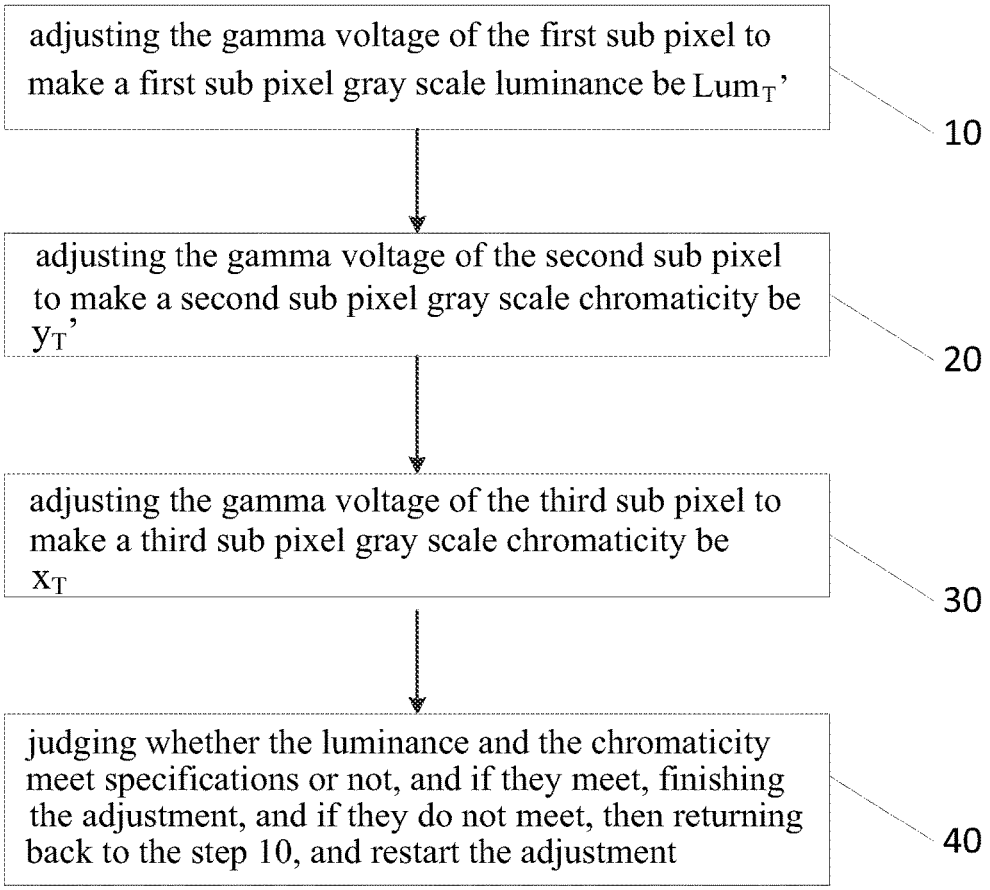
FIG. 2 is a flowchart of a precompensation method of adjusting luminance and chromaticity of a panel according to the present invention.

Please refer to FIG. 2, which is a flowchart of a precompensation method of adjusting luminance and chromaticity of a panel according to the present invention. The method mainly comprises:

employing $Lum_T$, $y_T$ and $x_T$ to respectively represent a first sub pixel target gray scale luminance, a second sub pixel target gray scale chromaticity and a third sub pixel target gray scale chromaticity; employing $Lum_c$ to represent a first sub pixel gray scale luminance precompensation value, and employing $y_c$ to represent a second sub pixel gray scale chromaticity precompensation value; employing Δy to represent a second sub pixel gray scale chromaticity variation value adjusted and corresponded with a gamma voltage of a second sub pixel, and employing Δx to represent a third sub pixel gray scale chromaticity variation value adjusted and corresponded with a gamma voltage of a third sub pixel; and sequentially performing:

step 10, adjusting the gamma voltage of the first sub pixel to make a first sub pixel gray scale luminance be $Lum_T$;

$$\begin{cases} Lum'_T = Lum_T + Lum_c \\ Lum_c = k_x * \Delta x + k_y * \Delta y \end{cases},$$

wherein $k_y$ is a variation coefficient of Δy to the first sub pixel gray scale luminance, and $k_x$ is a variation coefficient of Δx to the first sub pixel gray scale luminance;

step 20, adjusting the gamma voltage of the second sub pixel to make a second sub pixel gray scale chromaticity be $y_T$;

$$\begin{cases} y'_T = y_T + y_c \\ y_c = h_x * \Delta x \end{cases},$$

wherein $h_x$ is a variation coefficient of Δx to the second sub pixel gray scale chromaticity;

step 30, adjusting the gamma voltage of the third sub pixel to make a third sub pixel gray scale chromaticity be $x_T$;

step 40, judging whether the luminance and the chromaticity meet specifications or not, and if they meet, finishing the adjustment, and if they do not meet, then returning back to the step 10, and restart the adjustment.

The point of the present invention is to introduce the ideal of precompensation. Due to the mutual influences of adjusting luminance and chromaticity, the possible impact bias of the chromaticity to the luminance is pre considered in the setting of the target luminance to prevent the repeated cycle adjustment in the present invention.

Adjusting the gamma voltage can utilize linear estimation iteration. The adjustment specifically can comprises: identifying that variation of the gray scale luminance or gray scale chromaticity as a target and the gamma voltage meet a linear relationship, and obtaining a gamma voltage value corresponded with the target according to a linear computation; judging whether the target corresponding to the obtained gamma voltage value meets the specifications or not, and if it does not meet, keeping the linear estimation according to the obtained gamma voltage value.

The present invention provides the method which is simple and easy to realize to achieve the rapid adjustment of luminance and chromaticity of the panel. The precompensation avoids the multiple cycles of the luminance adjustment and the chromaticity adjustment, and with the linear estimation to adjust the gamma voltage, the efficiency of adjusting the gamma voltage is raised in advance. The linear property is better, and the efficiency is higher.

In the present invention, the first sub pixel, the second sub pixel and the third sub pixel are a sub pixel G, a sub pixel B and a sub pixel R constituting a pixel. As being a specific selection, the first sub pixel is a sub pixel G, and the second sub pixel is a sub pixel B and the third sub pixel is a sub pixel R.

According to the precompensation method of adjusting luminance and chromaticity of the panel according to the present invention, the present invention further provides a precompensation device of adjusting luminance and chromaticity of a panel, which can employed to perform the precompensation method of adjusting luminance and chromaticity of the panel according to the present invention, and comprises: a first sub pixel adjusting module, a second sub pixel adjusting module, a sub pixel adjusting module and a judging module, which sequentially works:

the first sub pixel adjusting module, adjusting the gamma voltage of the first sub pixel to make a first sub pixel gray scale luminance be $Lum_{T'}$;

$$\begin{cases} Lum'_T = Lum_T + Lum_c \\ Lum_c = k_x * \Delta x + k_y * \Delta y \end{cases},$$

wherein $k_y$ is a variation coefficient of Δy to the first sub pixel gray scale luminance, and $k_x$ is a variation coefficient of Δx to the first sub pixel gray scale luminance;

the second sub pixel adjusting module, adjusting the gamma voltage of the second sub pixel to make a second sub pixel gray scale chromaticity be $y_{T'}$;

$$\begin{cases} y'_T = y_T + y_c \\ y_c = h_x * \Delta x \end{cases},$$

wherein $h_x$ is a variation coefficient of Δx to the second sub pixel gray scale chromaticity;

the third sub pixel adjusting module, adjusting the gamma voltage of the third sub pixel to make a third sub pixel gray scale chromaticity be $x_T$;

the judging module, judging whether the luminance and the chromaticity meet specifications or not, and if they meet, finishing the adjustment, and if they do not meet, then the judging module restarting the adjustment.

Figure 3:
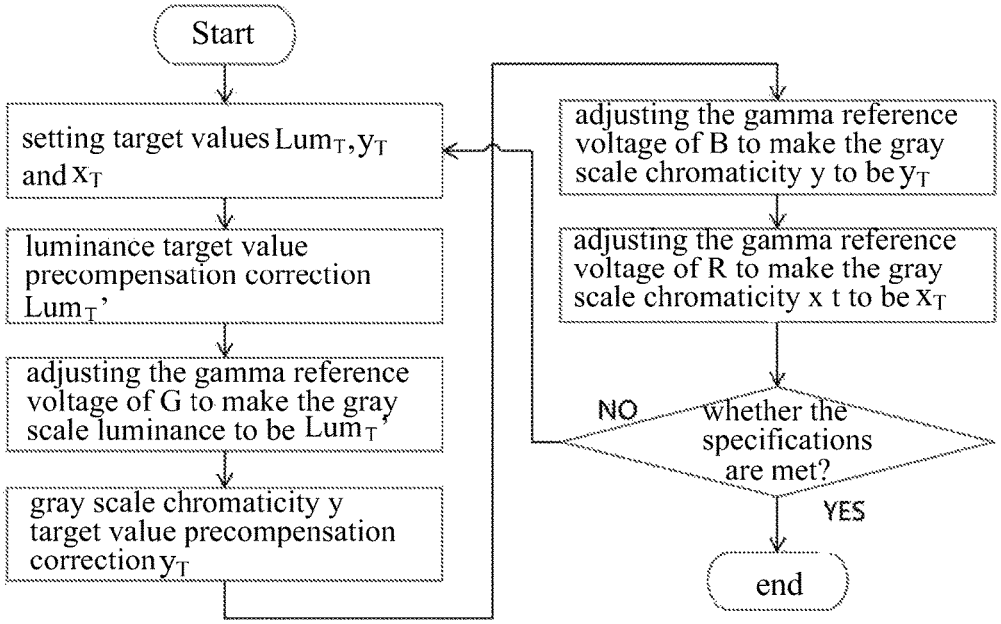
FIG. 3 is a flowchart of one preferred embodiment of a precompensation method of adjusting luminance and chromaticity of a panel according to the present invention.

Please refer to FIG. 3, which is a flowchart of one preferred embodiment of a precompensation method of adjusting luminance and chromaticity of a panel according to the present invention. In the preferred embodiment, Lum, y and x respectively represent the sub pixel G gray scale luminance, the sub pixel B gray scale chromaticity and the sub pixel R gray scale chromaticity; $Lum_T$, $y_T$ and $x_T$ are employed to respectively represent a sub pixel G target gray scale luminance, a sub pixel B target gray scale chromaticity and a sub pixel R target gray scale chromaticity; $Lum_c$ is employed to represent a sub pixel G gray scale luminance precompensation value, and $y_c$ is employed to represent a sub pixel B gray scale chromaticity precompensation value; Δy is employed to represent a sub pixel B gray scale chromaticity variation value adjusted and corresponded with a gamma voltage of a sub pixel B, and Δx is employed to represent a sub pixel gray R scale chromaticity variation value adjusted and corresponded with a gamma voltage of a R sub pixel.

As shown in FIG. 3, the gamma voltage correction gray scale luminance of G is adjusted first, and the correction target value $Lum_{T'}$ is to introduce the luminance precompensation value $Lum_c$ after the influence effect of Δy, Δx in the following adjustments of BR to the luminance on the basis of the target luminance $Lum_T$, i.e. $Lum_{T'}=Lum_T+Lum_c$, and the gamma voltage of G is adjusted to make the gray scale luminance to $Lum_{T'}$; then, the gamma voltage correction chromaticity y of B is adjusted, and the $y_{T'}$ is the to introduce the chromaticity precompensation value $y_c$ after the influence effect of Δx in the following adjustments of R to the chromaticity on the basis of the target $y_T$, i.e. $y_{T'}=y_T+y_c$, and the gamma voltage of B is adjusted to make the gray scale chromaticity to $y_{T'}$; finally, the gamma voltage correction chromaticity x of R is adjusted to the target chromaticity $x_T$. Whether the luminance and the chromaticity now meet specifications or not is judged, and if they do not meet, then the adjustment G→B→R is restarted in cyclic iteration.

The formula of gray scale luminance precompensation is below:

$$\begin{cases} Lum'_T = Lum_T + Lum_c \\ Lum_c = k_x * \Delta x + k_y * \Delta y \end{cases}$$

wherein the $Lum_T$ is a target luminance, $Lum_c$ is a target luminance precompensation value, and $k_y$ is a variation coefficient of the adjustment B of the chromaticity y deviation to the luminance, and $k_x$ is a variation coefficient of the adjustment R of the chromaticity x deviation to the luminance.

The gray scale chromaticity y precompensation:

$$\begin{cases} y'_T = y_T + y_c \\ y_c = h_x * \Delta x \end{cases}$$

wherein yT is a target chromaticity, $y_c$ is a target luminance precompensation value, and $h_x$ is a variation coefficient of the adjustment R of the chromaticity x deviation to the chromaticity.

Figure 4:
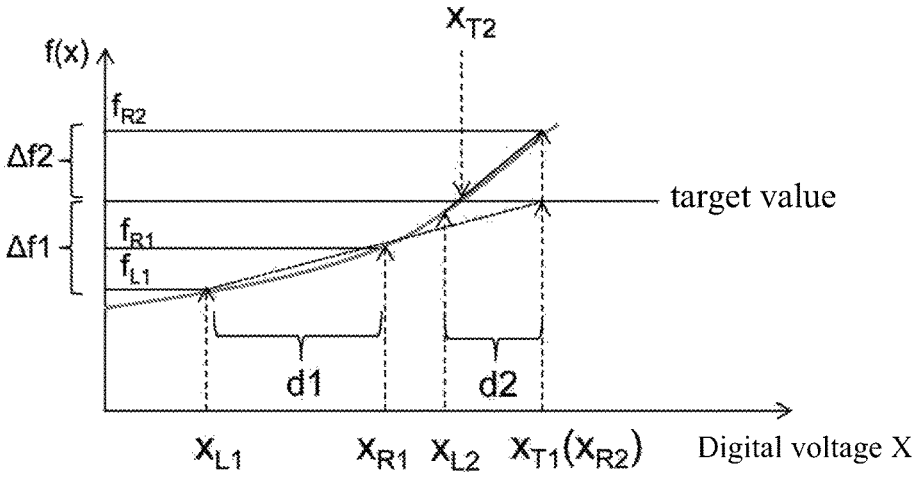
FIG. 4 is a diagram of adjusting the RGB gamma voltage with linear estimation iteration in one preferred embodiment of a precompensation method of adjusting luminance and chromaticity of a panel according to the present invention.

Please refer to FIG. 4, which is a diagram of adjusting the RGB gamma voltage with linear estimation iteration in one preferred embodiment of a precompensation method of adjusting luminance and chromaticity of a panel according to the present invention.

Because in the theoretical analysis, no matter the pattern of the luminance variation or the chromaticity variation and the gamma voltage meet the linear relationship, the adjusting the gamma voltage can utilize the linear estimation for rapid adjustment. Even the actual curve is not completely linear. The estimation deviation can be constantly decreased with iteration to rapidly converge to the specifications. As shown in FIG. 4, this is a diagram of linear estimation of two times of iterations. identifying that variation of the target value (the luminance or the chromaticity) and the gamma voltage meet a linear relationship, and a gamma voltage value corresponded with the target can be obtained according to a linear computation with the present point and the target values corresponded with the gamma values of two points with interval dn; whether the target corresponding to the obtained gamma voltage value meets the specifications or not can be judged, and if it does not meet, then the point is taken to be the reference point for keeping the linear estimation, wherein the selection of the interval of two points is related with the deviation value, and with the increase of the times of iteration, the deviation is gradually decreased, and the interval range is gradually decreased, and the linear estimation also gets more and more accurate. Moreover, the higher linear property is, the less the times of iteration is, and the efficiency of the adjustment is higher.

The formula of linear estimation is below:

$$\frac{f_R - f_L}{X_R - X_L} = \frac{\text{Target} - f_L}{X_T - X_L}.$$

The formula of reference interval selection is below:

$$d_n = K \times \Delta f_n,$$

wherein n is the times of cyclic iteration, and k is a step length coefficient, and Δfn is the deviation of variation value and the target value.

Figure 5:
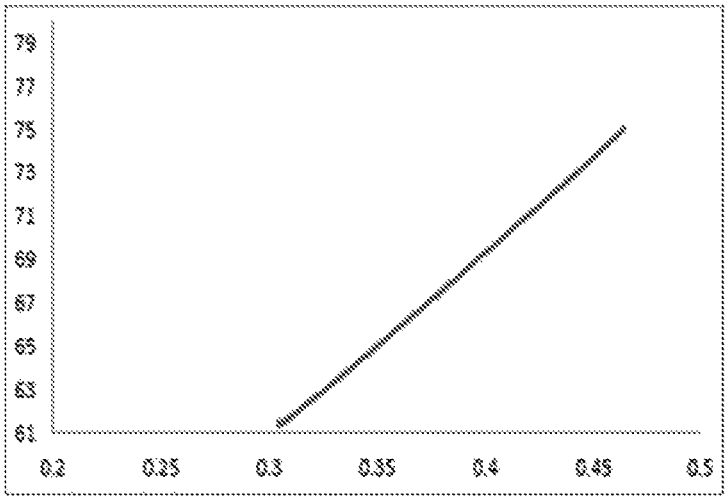
FIG. 5 is a curve diagram of adjusting R chromaticity x variation in accordance with luminance variation in one preferred embodiment of a precompensation method of adjusting luminance and chromaticity of a panel according to the present invention.
Figure 6:
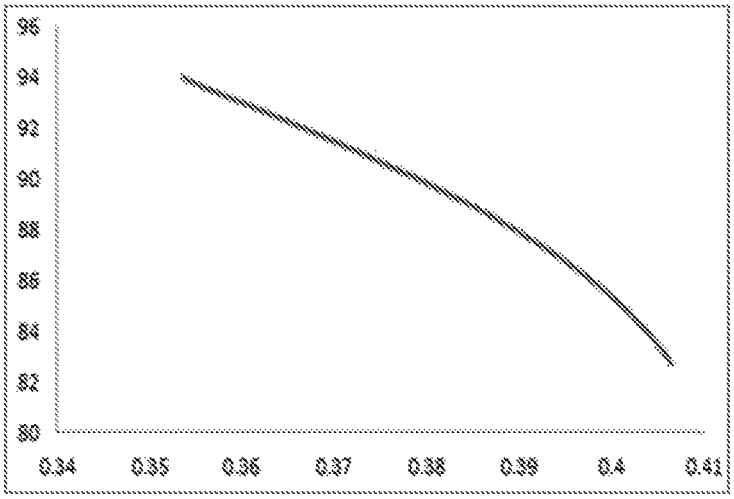
FIG. 6 is a diagram of adjusting B chromaticity y variation in accordance with luminance variation in one preferred embodiment of a precompensation method of adjusting luminance and chromaticity of a panel according to the present invention.
Figure 7:
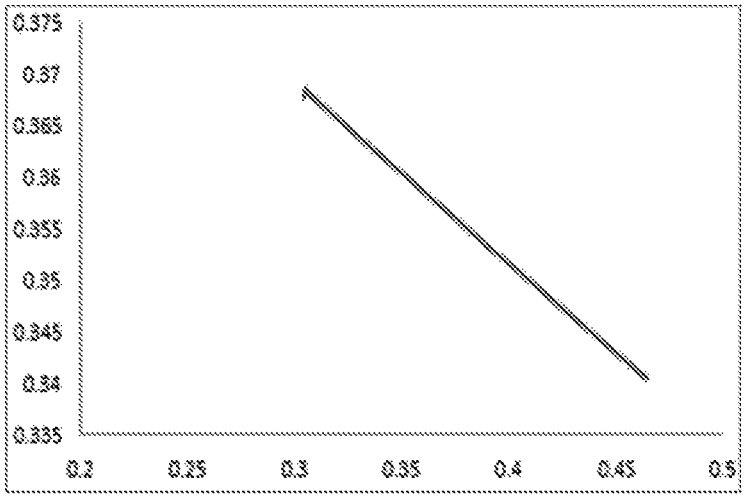
FIG. 7 is a curve diagram of adjusting R chromaticity x variation in accordance with chromaticity y variation in one preferred embodiment of a precompensation method of adjusting luminance and chromaticity of a panel according to the present invention.

Please refer FIGS. 5-7. FIG. 5 is a curve diagram of adjusting R chromaticity x variation in accordance with luminance variation in one preferred embodiment of a precompensation method of adjusting luminance and chromaticity of a panel according to the present invention. FIG. 6 is a diagram of adjusting B chromaticity y variation in accordance with luminance variation. FIG. 7 is a curve diagram of adjusting R chromaticity x variation in accordance with chromaticity y variation. As being told in the embodiment of the practical measurement, as adjusting the gamma voltage, the variation patterns between the luminance and the chromaticity, the chromaticity y and the chromaticity x basically meet the linear relationship. Thus, the precompensation has feasibility, which can accurately estimate the influence deviation of the following adjustment to the adjustment now. This deviation is pre added into the setting of the target value to effectively prevent the repeated multiple adjustments to rapidly find out the RGB gamma voltages corresponded with the target values of the luminance and the chromaticity. According to the variation of the gamma reference voltage of adjusting RB in the practical measurement in accordance with the luminance and the chromaticity, the variation coefficient $k_x$ of luminance relative to chromaticity as adjusting R, the variation coefficient $k_y$ of luminance relative to chromaticity y as adjusting B, the variation coefficient $h_x$ of chromaticity y relative to chromaticity x as adjusting R can be respectively obtained. Namely, $k_y$, $k_x$ and $h_x$ can be predetermined according to FIGS. 5-7.

In this preferred embodiment:

with adjusting the RGB gamma reference voltage to correct the luminance and the chromaticity of the panel, sequentially adjusting the gamma voltage correction luminance of G, adjusting the gamma voltage correction chromaticity of G, and adjusting the gamma voltage correction chromaticity x of R;

as adjusting G to correct the luminance, the target value of the luminance correction needs the precompensation correction, and the chromaticity deviations Δx and Δy at this moment are converted to be the precompensation values of the luminance with the variation coefficient of RB relative to the chromaticity and the luminance, and the addition of target luminance and the precompensation value of the luminance is the practical adjustment target luminance;

as adjusting B to correct the chromaticity y, the correction target value of the chromaticity y similarly needs the precompensation correction, and the chromaticity deviations Δx is converted to be the precompensation value of the chromaticity with the variation coefficient of R relative to the chromaticity y and the chromaticity x, and the addition of target chromaticity y and the precompensation value of the chromaticity y is the practical adjustment chromaticity y;

as adjusting R, the target chromaticity x is the practical adjustment chromaticity x;

adjusting the gamma voltage utilizes linear estimation iteration to raise the adjusting efficiency.

The preferred embodiment has advantages as described below:

1. Introduction of the precompensation correction mechanism, and as adjusting G, the setting of the luminance target value is added into the influence value of the chromaticity deviation to the luminance in the following adjustment, and the precompensation is first done to prevent readjustment of luminance after the chromaticity is adjusted with RB to prevent circular multiple adjustments to shorten the adjustment time and to raise the efficiency;

2. The adjustment result of the luminance will be influenced by the adjustment of the chromaticity, and the introduction of the precompensation can effectively prevent the vibration occurrence in the adjustment, i.e. the chromaticity deviation caused by the luminance adjustment and the luminance deviation caused by the chromaticity adjustment mutually cancel out each other to adjust the condition of being eventually unable to converge;

3. The linear estimation iteration is introduced to adjust the gamma voltage to raise the efficiency of adjusting the gamma voltage.

In conclusion, the precompensation method and the device of adjusting luminance and chromaticity of the panel according to the present invention introduces the precompensation correction mechanism capable of preventing circular multiple adjustments to shorten the adjustment time and to raise the efficiency; the vibration occurrence in the adjustment can be effectively prevented to adjust the condition of being eventually unable to converge; furthermore, linear estimation iteration is introduced to adjust the gamma voltage to raise the efficiency of adjusting the gamma voltage.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A precompensation method of adjusting luminance and chromaticity of a panel, comprising:

employing $Lum_T$, $y_T$ and $x_T$ to respectively represent a first sub pixel target gray scale luminance, a second sub pixel target gray scale chromaticity and a third sub pixel target gray scale chromaticity; employing $Lum_c$ to represent a first sub pixel gray scale luminance precompensation value, and employing $y_c$ to represent a second sub pixel gray scale chromaticity precompensation value; employing Δy to represent a second sub pixel gray scale chromaticity variation value adjusted and corresponded with a gamma voltage of a second sub pixel, and employing Δx to represent a third sub pixel gray scale chromaticity variation value adjusted and corresponded with a gamma voltage of a third sub pixel; and sequentially performing:

step 10, adjusting the gamma voltage of the first sub pixel to make a first sub pixel gray scale luminance be $Lum_{T'}$;

$$\begin{cases} Lum'_T = Lum_T + Lum_c \\ Lum_c = k_x * \Delta x + k_y * \Delta y \end{cases},$$

wherein $k_y$ is a variation coefficient of Δy to the first sub pixel gray scale luminance, and $k_x$ is a variation coefficient of Δx to the first sub pixel gray scale luminance;

step 20, adjusting the gamma voltage of the second sub pixel to make a second sub pixel gray scale chromaticity be $y_{T'}$;

$$\begin{cases} y'_T = y_T + y_c \\ y_c = h_x * \Delta x \end{cases},$$

wherein $h_x$ is a variation coefficient of Δx to the second sub pixel gray scale chromaticity;

step 30, adjusting the gamma voltage of the third sub pixel to make a third sub pixel gray scale chromaticity be $x_T$;

step 40, judging whether the luminance and the chromaticity meet specifications or not, and if they meet, finishing the adjustment, and if they do not meet, then returning back to the step 10, and restart the adjustment.

2. The precompensation method of adjusting luminance and chromaticity of the panel according to claim 1, wherein adjusting the gamma voltage utilizes linear estimation iteration.

3. The precompensation method of adjusting luminance and chromaticity of the panel according to claim 2, comprising:

identifying that variation of the gray scale luminance or gray scale chromaticity as a target and the gamma voltage meet a linear relationship, and obtaining a gamma voltage value corresponded with the target according to a linear computation;

judging whether the target corresponding to the obtained gamma voltage value meets the specifications or not, and if it does not meet, keeping the linear estimation according to the obtained gamma voltage value.

4. The precompensation method of adjusting luminance and chromaticity of the panel according to claim 1, wherein the first sub pixel, the second sub pixel and the third sub pixel are a sub pixel G, a sub pixel B and a sub pixel R constituting a pixel.

5. The precompensation method of adjusting luminance and chromaticity of the panel according to claim 1, wherein the first sub pixel is a sub pixel G, and the second sub pixel is a sub pixel B and the third sub pixel is a sub pixel R.

* * * * *